United States Patent [19]

Iwasaki et al.

[11] Patent Number: 4,565,064

[45] Date of Patent: Jan. 21, 1986

[54] PROCESS AND APPARATUS FOR PREPARING FASCIATED SPUN YARNS

[75] Inventors: Takeru Iwasaki, Ichinomiya; Kenji Sasaki, Komaki; Hiroshi Enomoto, Aichi, all of Japan

[73] Assignee: Howa Kogyo Kabushiki Kaisha, Nagoya, Japan

[21] Appl. No.: 641,844

[22] Filed: Aug. 17, 1984

[30] Foreign Application Priority Data

| | | | |
|---|---|---|---|
| Aug. 19, 1983 | [JP] | Japan | 58-152163 |
| Sep. 13, 1983 | [JP] | Japan | 58-170164 |
| Sep. 13, 1983 | [JP] | Japan | 58-170165 |

[51] Int. Cl.[4] ..... D01H 1/135; D01H 7/882; D01H 7/90

[52] U.S. Cl. ..... 57/404; 57/328; 57/333; 57/411; 57/413; 57/414; 57/417

[58] Field of Search ..... 57/328, 327, 333, 403, 57/404, 408, 409, 411, 413–417

[56] References Cited

U.S. PATENT DOCUMENTS

| | | | |
|---|---|---|---|
| 3,481,128 | 12/1969 | Landwehrkamp et al. | 57/417 |
| 3,834,147 | 9/1974 | Havranek et al. | 57/417 |
| 4,110,961 | 9/1978 | Havel et al. | 57/417 |
| 4,166,354 | 9/1979 | Duba | 57/417 |
| 4,302,925 | 12/1981 | Edagawa et al. | 57/409 X |
| 4,322,942 | 4/1982 | Fajt et al. | 57/404 X |
| 4,455,819 | 6/1984 | Suzuki et al. | 57/328 X |
| 4,458,477 | 7/1984 | Raasch et al. | 57/415 |
| 4,479,348 | 10/1984 | Yasui et al. | 57/328 X |

FOREIGN PATENT DOCUMENTS

| | | | |
|---|---|---|---|
| 976512 | 11/1964 | United Kingdom . | |
| 993877 | 6/1965 | United Kingdom . | |
| 1358810 | 7/1974 | United Kingdom . | |
| 1383091 | 2/1975 | United Kingdom | 57/404 |

*Primary Examiner*—John Petrakes
*Attorney, Agent, or Firm*—Michael N. Meller

[57] ABSTRACT

This is a process and apparatus for the preparation of fasciated spun yarns, which includes feeding separate single fibers formed by opening and drafting a continuous staple fiber bundle into a rotor (20), collecting and holding the single fibers on a fiber-collecting portion of the rotor (20) and taking out the collected fibers through a center piece (26) by delivery rollers (33) while strongly false-twisting the collected fibers in the same direction as that of true twists given by the rotor (20) into a twisted yarn by a false-twisting apparatus arranged between the rotor (20) and the delivery rollers (33), wherein the separated single fibers are supplied to a travelling plane for the twisted yarn between the fiber-collecting portion of the rotor (20) and the center piece (26) to entangle some of the single fibers with the twisted yarn in the strongly false-twisted state, and the entangled single fibers are entwined around the periphery of the twisted yarn by subsequent release of the false twists of the twisted yarn.

11 Claims, 10 Drawing Figures

PROCESS AND APPARATUS FOR PREPARING FASCIATED SPUN YARNS

BACKGROUND OF THE INVENTION (1.) Field of the Invention

The present invention relates to a process and apparatus for manufacturing fasciated spun yarns by utilizing the open end spinning method.

(2.) Description of the Prior Art

As methods for the production of yarns of this type, there have been proposed a method in which, as disclosed in Japanese Unexamined Patent Publication No. 52-37837, the accumulation width of a fiber-collecting portion of a rotor is expanded, separated single fibers are supplied toward the inner wall-face of the rotor, the fibers are collected in the fiber-collecting portion by a centrifugal force due to rotation of the rotor, true twists are applied to the collected fibers by rotation of the rotor when the collected fibers are taken out by a delivery roller, and false twists are simultaneously applied to the collected fibers by a pneumatic false-twisting nozzle, and also a method in which, as disclosed in Japanese Unexamined Patent Publication No. 58-109630, separated single fibers are supplied to the inner-face of a drum rotor and deposited on an accumulation surface, a bundle of the deposited fibers is taken out and twisted by guide means rotated at a higher speed than that of the drum rotor, a deflector is engaged with the fiber bundle between the accumulation surface and guide means to broaden the width of the fiber bundle, and the broadened fiber bundle is false-twisted by a pneumatic false-twisting nozzle. However, these methods involve unsolved problems, in that in the former method, the width of the bundle of the deposited fibers is broaden so as to create a difference of the applied twists between the inner and outer layers of the fiber bundle, fluffs are created by this difference of the applied twists, and these fluffs are entwined around the twisted yarn by release of the false twists to form a fasciated yarn. Accordingly, it is difficult to uniformly deposit single fibers along the entire width of the accumulation surface, and a sufficient number of fluffs cannot be produced on the surface of the twisted yarn. Furthermore, as soon as fluffs are produced, the fluffs are entwined on the periphery of the twisted yarn, and the difference of the applied twists between the false-twisted fibers and the fluffs is reduced, with the result that fasciation twisting of the fluffs by untwisting is reduced and the fasciation effect is lowered. As a result of our experiments, it was found that even if a fasciated spun yarn is formed according to this method, the number of fasciated fibers is small and the strength of the yarn is very low. The pneumatic false twisting nozzle utilized for the former method is provided with a yarn passage aperture formed along the entire length thereof wherein the inside diameter of this aperture is uniform, and a jet aperture opened rectangular to the axis of the yarn passing aperture which is directed to the outlet of the yarn passing aperture, while the projection of the axis of the jet aperture on a plan perpendicular to the axis of the yarn passing aperture is tangent to the projection of the inside wall of the yarn passing aperture onto a plan perpendicular to the axis of the yarn passing aperture. Therefore, when compressed air is ejected from the jet aperture into the yarn passing aperture, a swirling jet stream is created along the inside wall of the yarn passing aperture so that false twists are applied to the fiber bundle passing through the yarn passing aperture, while a suction air stream from the inlet to the outlet of the yarn passing aperture is created so that a pulling tension toward the outlet of the yarn passing aperture is created. In the method utilizing such a pneumatic false twisting nozzle, where the twisted yarn is false-twisted by passing the twisted yarn taken out from the rotating rotor into a yarn passing aperture of a pneumatic false-twisting nozzle as described above, since the force of holding the top end of the yarn on the fiber-collecting portion of the rotor is weak, there is a risk that the twisted yarn is pulled out from the rotating rotor by a tension generated in the taking-out direction by a jetted air stream, and hence, sufficient false twist cannot be imparted to the twisted yarn. In the above-mentioned conventional pneumatic false-twisting nozzle, a swirling air current is produced in the yarn-passing aperture having a uniform diameter so as to apply false twists. Accordingly, even if the jetting direction of a jet aperture is made rectangular to the axis of the yarn passing aperture, it is difficult to apply sufficient false twists to the twisted yarn and it also is difficult to increase the spinning speed or the yarn strength. In the latter method, since the bundle of fibers deposited on the accumulation surface of the drum rotor is taken out while guiding by the guide means rotated at a high speed, it is difficult to control the difference of the rotation speed between the drum rotor and guide means so as to fit the yarn take-out speed, and moreover, thickness-unevenness is readily caused in the obtained fasciated spun yarn. Furthermore, a very complicated apparatus is required for carrying out this method, and hence, this method is not preferred from a practical viewpoint.

SUMMARY OF THE INVENTION

It is therefore a primary object of the present invention to solve the above-mentioned problems of the conventional process and apparatus for manufacturing fasciated spun yarns, more particularly to provide a process and apparatus for manufacturing fasciated spun yarns, in which the thickness-uniformity of a fasciated spun yarn can be maintained at a high level by creating the so-called doubling effect of the open end spinning method, the tenacity of this fasciated spun yarn can be increased, and the production of this fasciated spun yarn can be performed by very simple means.

In the process for manufacturing fasciated spun yarns according to the present invention, which attains the foregoing object, separated single fibers are fed into a rotor and collected on a fiber-collecting portion of the rotor, and when the collected fibers are taken out through a center piece by a delivery roller, the collected fibers are strongly false-twisted in the same direction as that of true twists given by the rotor by means of a false-twisting apparatus arranged between the rotor and delivery roller, and a twisted yarn is spun out. This process is characterized in that the single fibers are supplied to a travelling plane of the twisted yarn between the fiber-collecting portion of the rotor and the center piece to entangle some of the single fibers with the twisted yarn in the strongly false-twisted state, and the entangled single fibers are entwined around the periphery of the twisted yarn by subsequent untwisting of the false twists of the twisted yarn.

In order to carry out smoothly the process of the present invention for manufacturing fasciated spun yarns, it is necessary to give careful consideration to a pneumatic false-twisting apparatus, which is a most important element of the preparation apparatus. Namely it is necessary to solve the problems involved in the conventional apparatus and provide a structure such that in a pneumatic false-twisting nozzle, the top end of a twisted yarn is held on the fiber-collecting portion of the rotor effectively and insertion of a seed yarn can be easily performed at the start of spinning. In the present invention, the problems involved in the conventional apparatus can be solved by providing a structure as described below. A pneumatic false-twisting nozzle used in the present invention has a yarn passing aperture, and a twisted yarn passing through this yarn passing aperture is false-twisted by a compressed fluid. The diameter of the yarn passing aperture is increased on the side of a yarn inlet and decreased on the side of a yarn outlet, and a stepped portion is formed midway in the yarn passing aperture. An aperture for ejecting compressed air is formed in this large diameter portion of the yarn passing aperture in a direction tangential to the inner surface of the large diameter portion and inclined to the axis of the diameter-increased portion so that a jetted air stream is directed to the stepped portion, whereby catching of the top end of the twisted yarn is effectively carried out. On the other hand, the problem regarding the insertion of the seed yarn into the yarn passing aperture can be solved by discharging the jetted fluid from the yarn inlet side of the yarn passing aperture and arranging an element for freely controlling the jetted air stream when the seed yarn is inserted into the yarn passing aperture.

DESCRIPTION OF THE PREFERRED EMBODIMENTS

For the sake of better understanding of the present invention, the basic apparatus for carrying out the process of the present invention, which is illustrated in FIGS. 1 through 4, will now be described.

Figure 1:
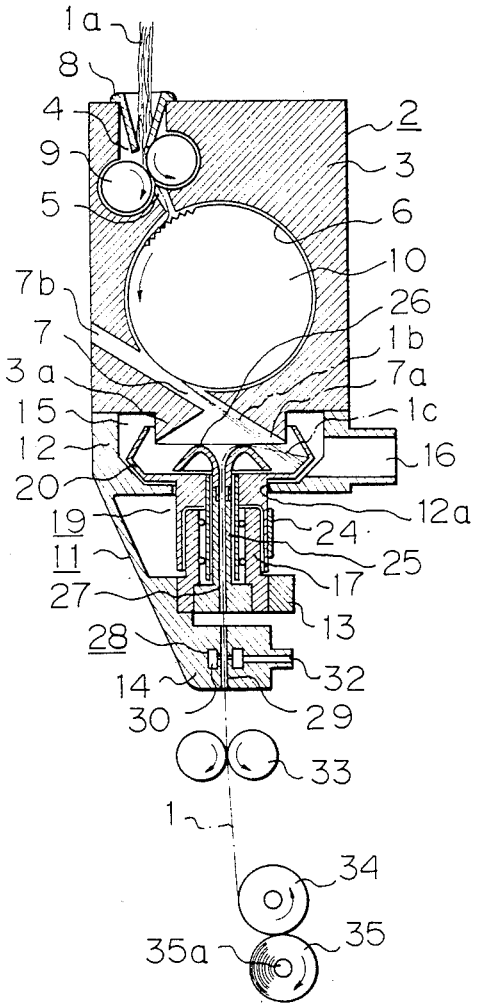
FIG. 1 is a sectional view showing an embodiment of the basic structure of an apparatus for carrying out the process of the present invention.
Figure 2:
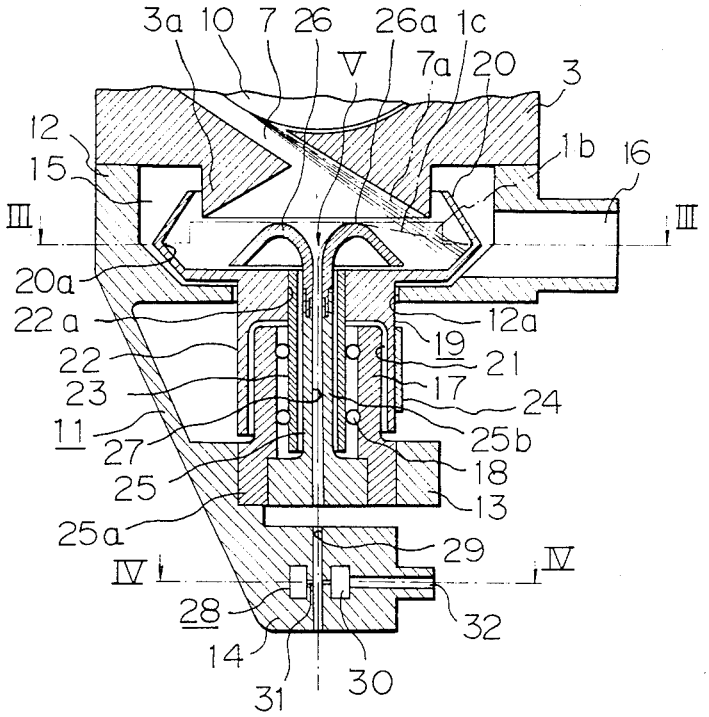
FIG. 2 is an enlarged sectional view showing a main part of FIG. 1.
Figure 3:
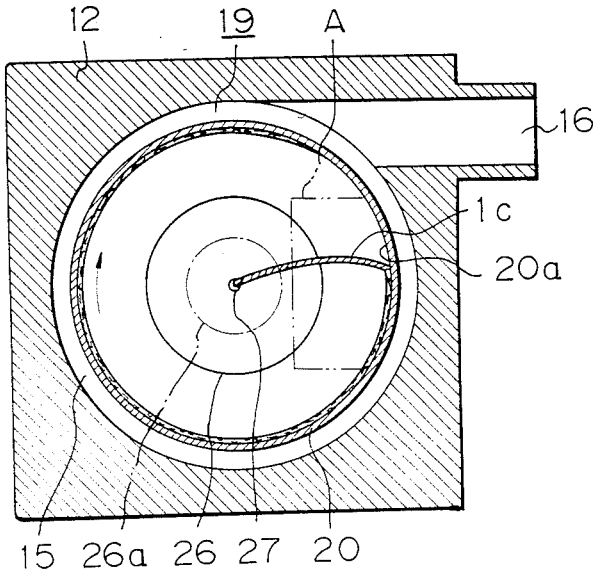
FIG. 3 is a view showing the section taken along the line III—III in FIG. 2.
Figure 4:
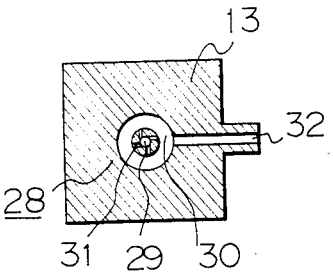
FIG. 4 is a view showing the section taken along the line, IV—IV in FIG. 2.

In the apparatus shown in FIGS. 1 through 4, reference numeral 2 represents an opener for opening and drafting a staple fiber bundle 1*a* such as a sliver into individual single fibers 1*b*. The opener 2 is vertically swingably pivoted on a machine stand (not shown) and is provided with a main body 3 disposed on a rotor housing described hereinafter. In this body 3, a fiber supply chamber 4, a fiber supply passage 5, an opening chamber 6, and a fiber delivery passage 7 are formed in sequence as shown in FIG. 1. A trumpet 8 and a feed roller 9 are disposed in the fiber supply chamber 4, and a combing roller 10 covered with, for example, a metallic wire on the peripheral surface, is rotatably disposed in the opening chamber 6. The feed roller 9 and combing roller 10 are rotated in a direction of an arrow by a driving motor (not shown), and the fiber bundle 1*a* guided into the trumpet 8 is fed into the opening chamber 6 and opened into individual single fibers 1*b*. The fiber delivery passage 7 is formed to extend tangentially to the peripheral surface of the combing roller 10, and a fiber outlet 7*a* is formed on one end of the fiber delivery passage 7 and an air intake opening 7*b* is formed on the other end of the fiber delivery passage 7. The fiber outlet 7*a* is formed in a conical shape, but the shape of the fiber outlet 7*a* is not necessarily limited to this conical shape. As shown in FIGS. 2 and 3, the fiber outlet 7*a* is arranged in a rotor as described below so that an extension of the fiber delivery passage 7 is directed to a travelling plane for a twisted yarn 1*c* in a position between a fiber-collecting portion 20*a* of the rotor 20 and a center piece 26. The shape and number of the fiber outlet 7*a* are not particularly critical, in so far as some of the single fibers 1*b* from the fiber outlet 7*a* are blown onto the twisted yarn 1*c* travelling on the travelling plane. However, if the number of true twists of the twisted yarn 1*c* which is created by rotation of the rotor is remarkably few, it is preferred that the fiber outlet 7*a* be constructed so that single fibers can be supplied to the entire travelling plane of the twisted yarn 1*c*. Reference numeral 11 represents a supporting block, which is forwardly tiltably pivoted on the machine stand, is secured at a rising position, and is disposed at a position below the opener 2. This supporting block 11 comprises a rotor housing 12, a rotor supporting portion 13, and a nozzle supporting portion 14. A circular rotor chamber 15 is formed on the top face of the rotor housing 12, and, as shown in FIGS. 2 and 3, an exhaust passage 16 is formed to connect the rotor chamber 15 to the exterior. The upper portion of the rotor chamber 15 is blocked by the main body 3 of the opener 2 disposed on the rotor housing 12. The lower portion of a supporting cylinder 17 is secured to the rotor supporting portion 13, and a rotor 19 is rotatably supported by a bearing 18 held on the inner surface of the supporting cylinder 17. This rotor 19 comprises a vessel-shaped rotor portion 20 having an upper portion opened, a wharve portion 22 integrated with the rotor chamber 20 and provided with a chamber 21 for containing the supporting cylinder 17 on the lower end surface thereof, and a cylindrical rotor shaft 23 fitted in a central aperture 22*a* of the wharve portion 22. This rotor shaft 23 is inserted into the supporting cylinder 17 and is supported by the bearing 18, and the wharve portion 22 is disposed in an aperture 12*a* of the rotor housing 12 and receives the supporting cylinder 17 in the containing chamber 21. The rotor portion 20 is formed within the rotor chamber 15. A driving belt 24 turned by a driving motor (not shown) is brought into contact with the outer periphery of the wharve portion 22 to rotate the rotor 19 in the direction of an arrow in FIG. 3. The fiber outlet 3*a* of the main body 3 is fitted in the upper opening of the rotor portion 20, and the fiber outlet 7*a* is brought close to the travelling plane of the twisted yarn 1*c* described hereinafter. A base 25*a* of a center piece attaching shaft 25 is fitted in the lower portion of the supporting cylinder 17, and a shaft portion 25*b* of the center piece attaching shaft 25 is inserted into the rotor shaft 23. A center piece 26 is detachably disposed to the top end of the shaft portion 25*b*. This center piece 26 is projected into the rotor portion 20, and, as shown in FIG. 1, a top 26*a* of the center piece 26 is located at a position higher than the fiber-collecting portion 20*a* (maximum diameter portion of the inner surface of the rotor) of the rotor portion 20, and by separating an annular surface defined by this top 26*a* and the fiber-collecting portion 20*a* of the rotor (this face is the travelling plane of the twisted yarn 1*c*) from the bottom surface of the rotor, a large space is formed below the annular surface. It is preferred that the distance between the travelling plane and the bottom surface of the rotor be such that single fibers 1*b* fed from the fiber delivery passage 7 are capable of arriving at the travelling plane without being disturbed by an air current impinging against the bottom surface. More specifically, it is preferred that this distance be adjusted to at least 3 mm. The top 26*a* of the center piece 26 may be located at a position lower than the fiber-collecting portion 20*a* of the rotor, but it is important that at least a space should be present below the annular surface so that the twisted yarn 1*c* directed to the center piece 26 from the fiber-collecting portion 20*a* of the rotor travels in the air. A yarn passing aperture 27 is formed in the center piece 26 and center piece attaching shaft 25. It is preferred that a smooth surface is formed on the fiber contacting surface of the center piece 26, that is, the top surface of the center piece 26, so that the friction resistance with the twisted yarn 1*c* is maintained at a level as low as possible and false twists given to the twisted yarn 1*c* by a false-twisting apparatus described hereinafter are sufficiently propagated even to the vicinity of the fiber-collecting portion 20*a* of the rotor. This function of the center piece is distinguished from that of the center piece in the conventional open end spinning frame. A pneumatic false-twisting nozzle 28 as an example of the false-twisting apparatus is disposed in the nozzle supporting portion 14. As shown in FIG. 4, this pneumatic false-twisting nozzle 28 comprises an annular space 30 with a yarn passing aperture 29 being as a center, a plurality of nozzle aperture 31 opened tangentially toward the yarn passing aperture 29 from the annular space 30, and a feed aperture 32 for feeding air to the annular space 30. This feed aperture 32 is connected to a compressed air source. The opening direction of the nozzle aperture 31 toward the yarn passing aperture 29 is set so that air jetted from the nozzle aperture 31 creates false twists of the same direction as that of the twists applied to the twisted yarn 1*c* by rotation of the rotor. The opening direction of the nozzle aperture 31 is a direction generating a vortex swirling in a reverse direction to the rotation direction of the rotor. It is preferred that this pneumatic false-twisting nozzle 28 be arranged as close to the rotor 19 as possible and the distance between the pneumatic false-twisting nozzle 28 and the fiber-collecting portion 20*a* of the rotor be as small as possible, whereby good propagation of false twists can be attained. In the above-mentioned embodiment, the pneumatic false-twisting nozzle 28 is directly formed in the nozzle supporting portion 14. However, a method may be adopted in which a pneumatic false-twisting nozzle 28 is separately constructed and is then attached to the supporting portion 14. The pneumatic false-twisting nozzle 28 is illustrated as the false-twisting apparatus in the drawings, but a mechanical false-twisting apparatus utilizing a belt or disk may be used instead. A pair of delivery rollers 33 are rotated in the direction of an arrow by a driving mechanism (not shown). In order to apply a false-twist to the twisted yarn 1*c* at a high efficiency, it is preferred that the nip point of the delivery rollers 33 be separate to some extent from the pneumatic false-twisting nozzle 28. Reference numeral 34 represents a winding roller for winding a taken-out fasciated spun yarn 1 in the form of a cheese 35.

Figure 5:
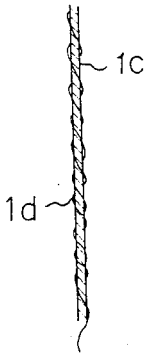
FIG. 5 is a side view showing the structure of a yarn at a point of an arrow V.
Figure 6:
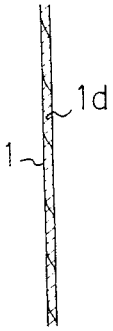
FIG. 6 is a side view showing the structure of a fasciated yarn according to the present invention.

The process for preparing a fasciated spun yarn by using the apparatus having the above-mentioned structure will now be described. The fiber bundle 1*a* is passed through the trumpet 8 of the opener 2 and supplied between the feed rollers 9, and by rotation of the feed rollers 9, the fiber bundle 1*a* is supplied to the surface of the combing roller 10. By rotation of the combing roller 10 in a direction of an arrow, the fiber bundle 1*a* is opened and drafted into single fibers 1*b* by teeth formed on the peripheral surface of the combing roller 10, the separated single fibers 1*b* are carried on an air stream fed to the fiber delivery passage, and are fed into the rotor portion 20 of the rotor 19. The single fibers 1*b* fed into the rotor portion 20 fall in contact with the inner surface of the rotor portion 20 rotated and are rotated together with the rotor portion 20. By a centrifugal force due to this rotation, the single fibers 1*b* are delivered to the fiber-collecting portion 20*a* on the inner surface of the rotor portion 20 and deposited in the form of fiber-layers on the fiber-collecting portion of the rotor. In the state where supply of compressed air to the pneumatic false-twisting nozzle 28 is stopped, a seed yarn is inserted into the yarn passing aperture 29 of the pneumatic false-twisting nozzle 28 and the yarn passing aperture 27 of the center piece attaching shaft 25 from a position downstream of the yarn passage and is guided into the rotor portion 20, and the top end of this seed yarn falls in engagement with the fiber bundle deposited on the fiber-collecting portion 20*a* of the rotor. Then, supply of compressed air into the pneumatic false-twisting nozzle 28 is started. In this state, the seed yarn is strongly false-twisted by the action of the pneumatic false-twisting nozzle 28. Accordingly, the top end of the seed yarn gives twists to the fiber layer with which the top end of the seed yarn is engaged. In a case where the seed yarn is guided between the delivery rollers 33 and between the winding roller 34 and a cheese bobbin 35*a* in this state, the seed yarn is taken out from the rotor portion 20 by the delivery rollers 33 and wound on the cheese 35, whereby the fiber layer on the fiber-collecting portion 20*a* of the rotor is separated from this position and is simultaneously twisted into a twisted yarn 1*c*. The twisted yarn 1*c* is guided onto the top surface of the center piece 26, taken out from the rotor 19 through the yarn passing aperture 27 and wound on the cheese 35. In this case, since the taken-out twisted yarn 1*c* is strongly false-twisted by the pneumatic false-twisting nozzle 28 at a position just downstream of the rotor 19, these strong false twists are propagated to the point close to the fiber layer on the fiber-collecting portion 20*a* of the rotor. As the top surface of the center piece 26 is smoothly finished as pointed out hereinbefore, false twists given to the twisted yarn 1*c* by the pneumatic false-twisting nozzle 28 can be propagated even to the position of the fiber-collecting portion 20*a* of the rotor, smoothly. Accordingly, false twists in a number much larger than the number of true twists by rotation of the rotor 19, can be propagated to the twisted yarn 1*c* between the center piece 26 and the fiber-collecting portion 20*a* of the rotor, whereby yarn breakage can be prevented even if the rotation number of the rotor 19 is reduced. When the fiber layer on the fiber-collecting portion 20*a* of the rotor is taken out from the rotor 19 in the form of the twisted yarn 1*c*, true twists are given to this twisted yarn 1*c* by rotation of the rotor 19. However, these true twists are involuntarily given by rotation of the rotor 19 which is conducted so as to collect and catch single fibers on the fiber-collecting portion 20*a* of the rotor, and these true twists nearly equal zero twists practically. Impartment of these true twists is not important for the fasciated spun yarn 1. For example, if the yarn count is a 30'S English Cotton Count, the rotation number of the rotor is 13,000 rpm and the spinning speed is 150 m/min, the true twist number is 2.2 twists/inch and no substantial yarn can be formed by only such twists. Moreover, when the fiber layer on the fiber-collecting portion 20*a* of the rotor is taken out from the rotor 19 in the form of the twisted yarn 1*c*, the twisted yarn 1*c* advanced from the fiber-collecting portion 20*a* of the rotor toward the center of the center piece 26 is rotated and travelled in the space of the rotor portion 20 with the center piece 26 as the center, and the above-mentioned separate single fibers are supplied to a part A of the travelling plane for the twisted yarn 1 from the fiber delivery passage 7 of the opener 2. Accordingly, some of the single fibers supplied to this travelling plane are blown onto the periphery of the twisted yarn 1*c*, which are strongly false-twisted as pointed out hereinbefore and entwined with and wrapped in the twisted yarn 1*c*, while the remaining single fibers 1*b* are collected on the fiber-collecting portion 20*a* of the rotor in the above-mentioned manner. In this case, at the part of the twisted yarn 1*c* to which the single fibers 1*b* are supplied, since the twisted yarn 1*b* is strongly false-twisted by the pneumatic false-twisting nozzle 28 in the above-mentioned manner, the difference between the twist number of the twisted yarn 1*c* in the false-twisted state and the twist number of the entwined fibers 1*d* on the periphery of the twisted yarn 1*c* becomes very great as shown in FIG. 5. Furthermore, the twisted yarn 1*c* between the fiber-collecting portion 20*a* of the rotor and the center piece 26 is rotated and travelled in air with the center piece 26 as the center as pointed out hereinbefore, and this twisted yarn 1*c* traverses the portion for supply of the single fibers 1*b*. Accordingly, many single fibers 1*b* can be entwined with the periphery of the twisted yarn 1*c*. If the rotation number of the rotor 19 and the spinning speed are appropriately chosen, the single fibers 1*b* can be entwined with the periphery of the twisted yarn 1*c* uniformly in the longitudinal direction. Then, the twisted yarn 1*c* having the periphery entwined with the single fibers 1*b* is passed through the yarn passing aperture 29 of the pneumatic false-twisting nozzle 28 and is taken out by the delivery rollers 33. When the twisted yarn 1*c* in the above-mentioned false-twisted state passes through the position of the pneumatic false-twisting nozzle 28 and receives an untwisting action, the number of the false twists on the twisted yarn 1*c* is reduced to zero and the twisted yarn 1*c* is in the truly twisted state with a very small twist number. Simultaneously, the entwined fibers 1*d* on the periphery of the twisted yarn 1*c* are given fasciation twists in a reverse direction to the twisting direction of the true twists with the untwisting of the twisted yarn 1*c*. These entwined fibers 1*d* are spirally wound on the periphery of the twisted yarn 1*c* in the slightly truly twisted state to exert a fasciation effect. At the point after the passage through the delivery rollers 33, a fasciated spun yarn 1 as shown in FIG. 6 is formed, and this fasciated spun yarn 1 is wound on the cheese 35. For example, where a fasciated spun yarn in a 30'S English Cotton Count is spun from staple fibers consisting 65% of a polyester and 35% of cotton at the condition of 13,000 rpm rotor speed and 150 m/min spinning speed, good results can be obtained.

In the above-mentioned embodiment, single fibers are supplied toward a part of the travelling plane for the twisted yarn, but the single fibers may be supplied toward the entire travelling plane for the twisted yarn. In this case, the single fibers may be supplied into the rotor through a plurality of fiber delivery passages. Furthermore, in the foregoing embodiment, the spun yarn is taken out in a reverse direction to the fiber supplying direction, but the spun yarn may be taken out in the same direction as the fiber supplying direction. Moreover, in the above-mentioned embodiment, since a staple fiber bundle is opened by utilizing the combing roller, there is attained an advantage in that the maintenance can be performed very easily. However, the opening method is not limited to this method.

As is apparent from the foregoing description, according to the present invention, separated single fibers are fed into the rotor and collected and held in the fiber-collecting portion of the rotor, and when the collected fibers are taken out through the center piece by the delivery roller, strong false twists are given to the collected fibers in the same direction as that of true twists given by the rotor, and the collected fibers are taken out in the form of a twisted yarn. Accordingly, the uniformity or bulkiness of the spun yarn can be maintained at a high level by dint of the doubling effect of the rotor type open end spinning method, and the quality of the fasciated spun yarn can be improved. Moreover, yarn breakage can be prevented throughout the spinning operation and spinning can be performed at a high speed even in the case of a fine yarn, and the productivity can be increased. Furthermore, single fibers are supplied toward the travelling plane for the twisted yarn between the fiber-collecting portion of the rotor and the center piece, and some of these single fibers are entangled with the twisted yarn in the strongly false- twisted state, and the entangled single fibers are entwined with the periphery of the twisted yarn by untwisting of the twisted yarn. Accordingly, the difference between the twist number of the twisted yarn in the false-twisted state and the twist number of the entangled single fibers can be increased and the number of the entangled single fibers can be increased, with the result that the fasciation effect by the entangled single fibers is enhanced and the tenacity of the fasciated yarn is increased. Moreover, since single fibers are supplied to the travelling plane for the twisted yarn, and some of them are positively entangled with the twisted yarn as pointed out hereinbefore, the single fibers can be uniformly entwined with the periphery of the twisted yarn, and the quality of the fasciated yarn can be advantageously maintained at a high level. Still further, in the present invention, since single fibers are entwined with the periphery of the twisted yarn by supplying the single fibers toward the travelling plane for the twisted yarn, this entwining operation can be accomplished by using a simple apparatus, and hence, the process is very advantageous from a practical viewpoint.

Figure 7:
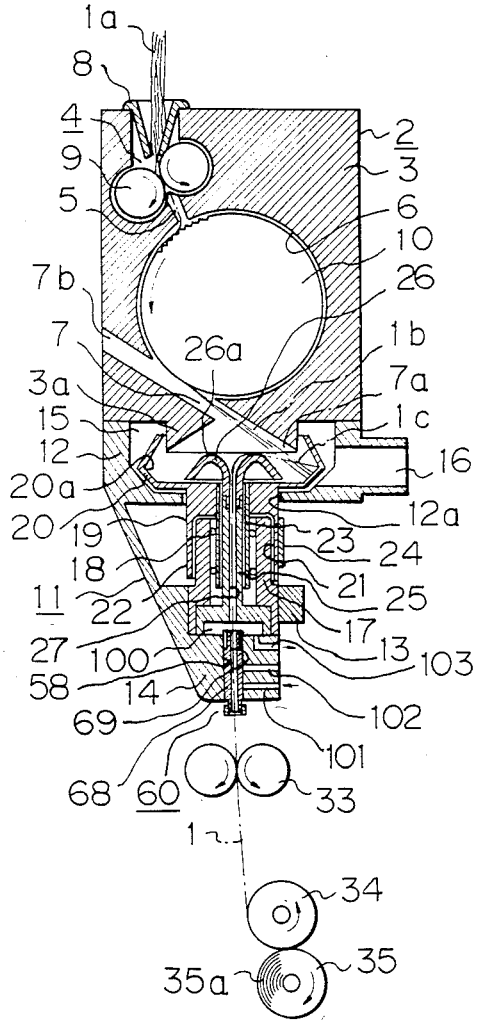
FIG. 7 is a sectional view showing a second embodiment of the apparatus for manufacturing fasciated yarns according to the present invention.
Figure 8:
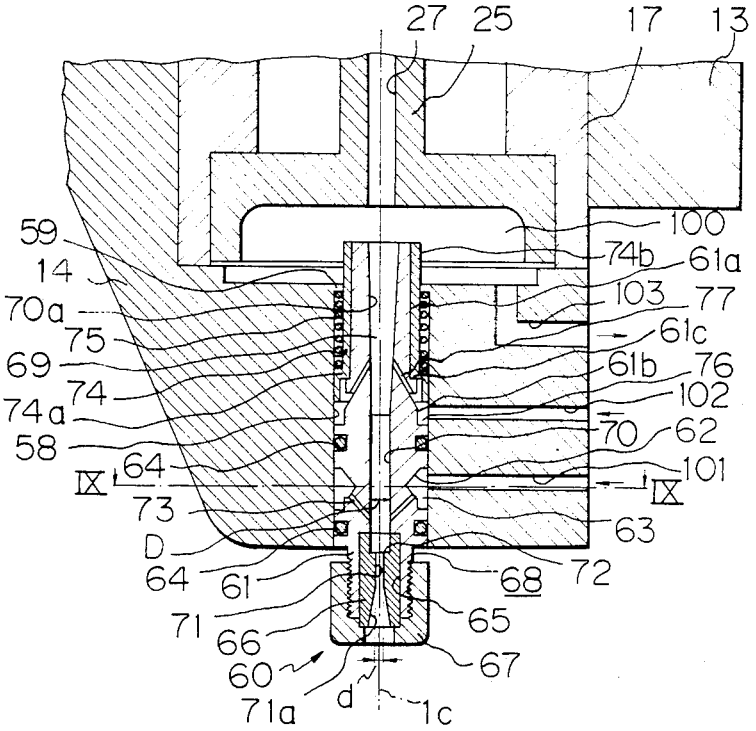
FIG. 8 is an enlarged sectional view showing a main part of the second embodiment shown in FIG. 7.
Figure 9:
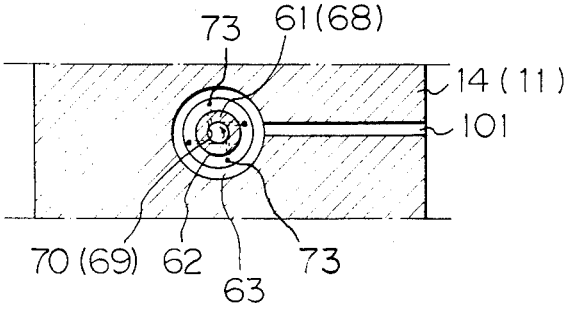
FIG. 9 is a view showing the section taken along the line IX—IX in FIG. 8.
Figure 10:
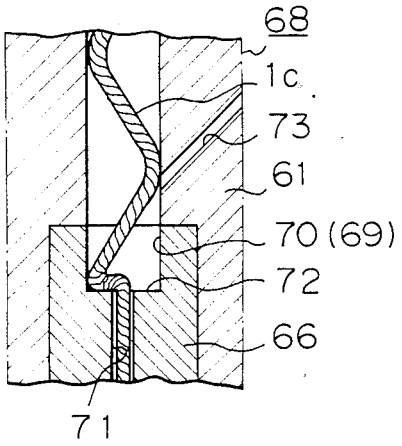
FIG. 10 is a sketch diagram for illustrating the action of a pneumatic false-twisting nozzle in the second embodiment.

When mill tests were repeatedly carried out by using the process and apparatus for preparing fasciated yarns, which have been described herein with reference to the first embodiment, it was found that problems to be solved were to increase the efficiency of the operation of handling the seed yarn at the start of spinning and to hold a free end of the twisted yarn effectively on the fiber-collecting portion of the rotor for improving the yarn quality. Accordingly we carried out further research, and as a result, it was found that good results are obtained when a pneumatic false-twisting nozzle having a structure described below with reference to the second embodiment is used. In this pneumatic false-twisting nozzle, the opening mechanism, rotating rotor mechanism, and take-up/winding mechanism shown in the first embodiment are directly utilized. Therefore, explanation of the structures and functions of the same elements as shown in the first embodiment is omitted. The second embodiment will now be described with reference to FIGS. 7 through 11. As pointed out hereinbefore, the opening mechanism, rotating rotor mechanism, and take-out/winding mechanism are substantially the same as in the first embodiment, but because of the special structure of the pneumatic false-twisting nozzle used in this second embodiment, an exhaust chamber 100 is formed between the center piece attaching shaft 25 and the nozzle supporting portion 14. The center piece 26 is detachably disposed to the top end of the center piece attaching shaft 25. As pointed out hereinbefore, the present embodiment is characterized by the special structure of the false-twisting nozzle. This characteristic structure will now be described in detail. As shown in FIG. 7 and FIG. 8, a through aperture 58 is formed along the same line as the yarn passing aperture 27 in the nozzle supporting portion 14, and an annular spring receiving seat 59 is projected on the inner face of the top end portion of the through aperture 58. A pneumatic false-twisting nozzle having a structure shown in FIGS. 8 and 9 is fitted in the through aperture 58. The pneumatic false-twisting nozzle 60 comprises a cylindrical first body 61 fitted in the through aperture 58, and the yarn inlet side end portion of the first body 61 is projected into the exhaust chamber 100 to form a certain distance from the center piece attaching shaft 25. A concave groove 62 is formed along the entire periphery of the intermediate portion of the first body 61 to form an annular space 63 between the concave groove 62 and the inner face of the through aperture 58. The annular space 63 is connected to a compressed air source through a passage 101 via a valve. The upper and lower sides of the annular space 63 are sealed by O-rings 64 fitted in the periphery of the first body 61. A fitting aperture 65 is formed in the yarn outlet side end portion (lower end portion) of the first body 61, and a second body 66 is fitted in this fitting aperture 65 and is exchageably secured by a lock nut 67 screwed to the periphery of the yarn outlet side end portion of the first body 61. A nozzle proper 68 is constructed by the first body 61, second body 66, and lock nut 67, and a yarn passing aperture 69 pierces the central portion of the nozzle proper 68. The yarn passing aperture 69 has a large-diameter portion 70 on the yarn inlet side and a small-diameter portion 71 on the yarn outlet side, and a step 72 is formed midway in the yarn passing aperture 69 of the second body 66. An upwardly expanded taper aperture 70*a* is formed on the top end of the large-diameter portion 70 and a downwardly expanded taper aperture 71*a* is formed on the lower end of the small-diameter portion 71. A plurality of jet apertures 73 formed in the first body 61 from the annular space 63 to the large-diameter portion 70 are opened to the large-diameter portion 70. As shown in FIG. 9, each of these jet apertures 73 is arranged tangentially to the inner face of the large-diameter portion 70 and inclined to the axis of the large-diameter portion 70 so that an air stream jetted from the jet aperture 73 is directed toward the step 72. The jet aperture 73 is opened to the yarn passing aperture 69 in a direction such the compressed air jetted from the jet aperture 73 gives the twisted yarn 1*c* passing through the yarn passing aperture 69 false twists of the same direction as the direction of true twists given to the twisted yarn 1*c* by rotation of the rotor (in a direction generating a vortex swirling in a reverse direction to the rotation direction of the rotor). The distance between the outlet of the jet aperture 73 and the step 72 is not particularly critical, so far as the swirling stream of jetted air impinges against the step 72 and is turned. The diameter d of the small-diameter portion 71 is adjusted so that in the state where the twisted yarn 1*c* is passed through the small-diameter portion 71, air jetted from the jet aperture 73 is not substantially allowed to flow into the yarn outlet side from the small-diameter portion 71, and the diameter D of the large-diameter portion 70 is set so that the twisted yarn 1*c* is swirled in the large-diameter portion 70 by the jetted air stream at a high efficiency and ballooning is caused. From the results of our experiments, it was found that in view of the count number of the spun yarn it is preferred that the diameter d of the small-diameter portion 71 should satisfy the requirement of $0.5\ mm < d < 2.0\ mm$ and the diameter D of the large-diameter portion 70 should satisfy the requirement of $D \geqq 2.0d$. Where a special yarn is formed, other conditions may be adopted. Since the yarn passing aperture 69 of the first body 61 and second body 66 is worn away by friction with the twisted yarn 1*c*, the first body 61 and second body 66 are formed of an abrasion-resistant material, and since the step 72 of the yarn passing aperture 69 is especially easily worn away, the second body 66 is formed of a new ceramic material, and a spare second body 66 is provided and the worn second body 66 is exchanged with this spare second body 66. In this case, since the new ceramic material is expensive, and in order to reduce the cost, it is preferred that the second body 66 be divided into two parts, that is, the step 72 and the other portion, and only the step 72 be formed of a new ceramic material. Of course, the nozzle proper 78 may be constructed by one member. Two-stage small-diameter portions 61*a* and 61*b* are formed on the periphery of the yarn inlet side end portion of the first body 61, and a step 61*c* is formed as a stopper midway. A closing cylinder 74 is fitted in the small-diameter portion 61*a* slidably in the axial direction of the first body 61. A wedge-like piston portion 74*a* slidably fitted in the inner face of the through aperture 58 is formed on the downstream end of the closing cylinder 74. The closing cylinder 74 is urged toward the yarn outlet by a spring 75 compressed and sealed between the piston portion 74*a* and the spring receiving seat 59 of the nozzle supporting portion 14 and is ordinarily fixed while impinging against the step 61*c*. Where the closing cylinder 74 impinges against the step 61*c*, an annular piston chamber 76 is defined by the piston portion 74*a*, the periphery of the small-diameter portion 61*b*, and the inner face of the through aperture 58, and the yarn inlet side portion of the closing cylinder 74 is extended to the same position as that of the yarn inlet end portion of the first body 61. The yarn inlet side end portion of the closing cylinder 74 is formed in a closing portion 74*b* so that when the closing cylinder 74 is slid to the yarn inlet side, the closing portion 74*b* of the closing cylinder 74 abuts exactly onto the lower face of the center piece attaching shaft 25 to connect the yarn passing aperture 27 to the yarn passing aperture 69 in a straight line. The annular piston chamber 76 is connected to the compressed air source through a supply passage 102 via a valve. The annular piston chamber 76 is connected to the yarn passing aperture 69 through a plurality of jet apertures 77 directed to the axis of the yarn passing aperture 69. A plurality of jet apertures 77 incline to the axis of the yarn passing aperture 69 so that compressed air is jetted toward the yarn inlet side. The exhaust chamber 100 is connected to an air-flow cleaner through an exhaust passage 103. A pair of delivery rollers 33 are rotated in the direction of an arrow by a driving mechanism (not shown). In order to apply a false-twist to the twisted yarn 1*c* at a high efficiency, it is preferred that the nip point of the delivery rollers 33 be separate to some extent from the pneumatic false-twisting nozzle 60. Reference numeral 34 represents a winding roller for winding a taken-out fasciated spun yarn 1 in the form of a cheese 35.

The process for preparing the fasciated spun yarn 1 by using the apparatus having the above-mentioned structure will now be described.

Where supply of compressed air to the annular space 63 in the pneumatic false-twisting nozzle 60 is stopped, when compressed air is supplied to the annular piston chamber 76, the pressure in the annular piston chamber 76 is elevated to press the piston portion 74*a* of the closed cylinder 74, whereby the closed cylinder 74 is slid toward the yarn inlet side against the spring 75 and the closed portion 74*b* is caused to abut onto the lower face of the center piece supporting shaft 25. Accordingly, the yarn passing aperture 27 of the center piece supporting shaft 25 and the yarn passing aperture 69 of the nozzle proper 68 are disconnected from the exhaust chamber 100, and no influences are given by a sucked air current generated by the air-flow cleaner. By supply of compressed air into the annular piston chamber 76, compressed air is upwardly jetted into the yarn passing aperture 69 from the jet aperture 77, and the jetted air stream is discharged into the rotor chamber 15 through the yarn passing aperture 27. Simultaneously, by the ejecting effect by jetting of the compressed air, a sucking force acting toward the yarn inlet is produced in the yarn passing aperture 69 of the nozzle proper 68. If the top end of a seed yarn is brought close to the taper hole 71*a* of the yarn passing aperture 69 in this state, the seed yarn is sucked in the yarn passing aperture 69 by the above-mentioned sucking force and delivered into the rotor portion 20 of the rotor 10 by the jetted air stream from the jet aperture 77. The top end of the seed yarn guided into the rotor portion 20 is held on the fiber-collecting portion 20*a* of the rotor by a centrifugal force due to rotation of the rotor 19. Then, supply of the compressed air to the annular piston chamber 76 is stopped. The closing cylinder 74 is slid downstream and returned to the original position by the force of the spring 75, and jetting of the compressed air into the yarn passing aperture 69 from the jet aperture 77 is stopped. If the feed roller is rotated in this state, the fiber bundle 1*a* is supplied to the surface of the combing roller 10, and by rotation of the combing roller 10 in the direction of an arrow, the fiber bundle 1*a* is opened and drafted into separated single fibers 1*b* by teeth on the peripheral surface of the combing roller 10, and the separated single fibers 1*b* are carried on an air stream fed to the fiber delivery passage 7 and supplied into the rotor portion 20. The single fibers 1*b* supplied into the rotor portion 20 fall in contact with the inner surface of the rotor portion 20 driven and rotated and are rotated together with the rotor portion 20. By a centrifugal force due to this rotation, the single fibers 1*b* are delivered to the fiber-collecting portion 20*a* on the inner surface of the rotor portion 20 and deposited on this fiber-collecting portion 20*a* in the form of layers, and simultaneously, the single fibers 1*b* are engaged with the seed yarn held on the fiber-collecting portion 20*a* of the rotor. If the seed yarn is guided between the delivery rollers 33 in this state, this guidance is detected by a detector (not shown) to start the supply of compressed air into the annular space 63 in the pneumatic false-twisting nozzle 60. Of course, this supply of compressed air into the annular space may be started manually by a switch. Supply of compressed air for the insertion of the seed yarn may be stopped by a detection signal emitted when the seed yarn is guided between the delivery rollers 33. By the supply of compressed air into the annular space 63, compressed air is jetted into the large-diameter portion 70 of the yarn passing aperture 69 toward the yarn outlet in the direction tangential from the jet apertures 73, and the jetted air current is turned along the inner surface of the large-diameter portion 70 in a reverse direction to the rotation direction of the rotor and impinges against the step 72. The jetted air stream is turned on the step 72 and flows toward the yarn inlet through the large-diameter portion 70, and the air stream is then discharged into the exhaust chamber 100 above the pneumatic false-twisting nozzle 60 and sucked into the air-flow cleaner. Since the swirling air stream is produced in the large-diameter portion 70 as described above, the taken-out seed yarn is immediately turned and false-twisted by the swirling air current and the top end of the seed yarn gives twists to the fiber bundle engaged with the seed yarn to form a twisted yarn 1*c*. This twisted yarn 1*c* is taken out. As in the first embodiment, the taken-out twisted yarn 1*c* is wound on the cheese 35. In this case, air jetted into the yarn passing aperture 69 in the pneumatic false-twisting nozzle 60 forms a swirling air stream as shown in FIG. 5, and the swirling air current impinges against the step 72 and is turned on the step 72. Accordingly, it is expected that the swirling air stream in the large-diameter portion 70 will press the twisted yarn 1*c* in the yarn passing aperture 69 to the step 72 in the large-diameter portion 70 and positively turn the twisted yarn 1*c* . Accordingly, the twisted yarn 1*c* is strongly false-twisted in the same direction as that of the true twists of the twisted yarn 1*c* at a high efficiency. From the results of our experiments, it was confirmed that the tenacity of the fasciated spun yarn 1 prepared by using the pneumatic false-twisting nozzle 60 is much higher than that of the fasciated spun yarn prepared by using the conventional pneumatic false-twisting nozzle. As pointed out above, the compressed air jetted into the large-diameter portion 70 impinges against the step 72 and then flows toward the yarn inlet, and this compressed air does not impose a tension acting in a direction toward the yarn outlet (yarn take-out direction) on the twisted yarn 1*c* in the yarn passing aperture 69 and yarn passing aperture 27. Accordingly, the top end of the twisted yarn 1*c* being taken out from the rotor 19 can be held on the fiber-collecting portion 20*a* effectively, and since the twisted yarn 1*c* is false-twisted, falling-out of the twisted yarn 1*c* from the rotor 19 can be prevented. Since the twisted yarn 1*c* taken out from the rotor 19 is strongly false-twisted by the pneumatic false-twisting nozzle 60 just below the rotor 19, these strong false twists can be propagated to the vicinity of the fiber layer on the fiber-collecting portion 20*a* of the rotor. In the case that the top face of the center piece 26 is smoothly finished, as pointed out above, false twists given by the pneumatic false-twisting nozzle 60 to the twisted yarn 1*c* can be propagated to the position of the fiber-collecting portion 20*a* of the rotor conveniently. Accordingly, false twists in a twist number much larger than the twist number of true twists given by rotation of the rotor 19 can be propagated to the twisted yarn 1*c* between the center piece 26 and the fiber-collecting portion 20*a* of the rotor, and even if the rotation number of the rotor 19 is reduced, the occurrence of yarn breakage can be prevented.

When a fasciated yarn 1 is prepared in the above-mentioned manner, the majority of compressed air jetted from the jet aperture 73 of the pneumatic false-twisting nozzle 60 is discharged into the exhaust chamber 100 and sucked into the air-flow cleaner, and dusts such fiber wastes produced by false twisting are simultaneously removed. When the step 72 of the second body 66 of the pneumatic false twisting nozzle 60 is worn away, the lock nut 67 is detached and the second body 66 can be easily exchanged with a new body.

As is apparent from the foregoing illustration, in the second embodiment, the closing cylinder is slidably fitted in the yarn inlet side end portion of the pneumatic false-twisting nozzle and is urged toward the yarn outlet side to impinge against the stopper, the annular piston chamber is arranged on the yarn outlet side of this closing cylinder, and the jet apertures are disposed to connect this annular piston chamber to the yarn passing aperture 69. Accordingly, by supplying compressed air into this annular piston chamber at the start of spinning, the yarn passing aperture 57 can be connected to the yarn passing aperture 69 in a straight line and a sucking force toward the yarn inlet can be produced in the yarn passing aperture 69. Therefore, insertion of the seed yarn at the start of spinning can be performed very easily. Furthermore, the pneumatic false-twisting nozzle is constructed so that the jet air stream is discharged from the yarn inlet side of the yarn passing aperture of the pneumatic false-twisting hole, and the nozzle proper of the pneumatic false-twisting nozzle is arranged so that a certain space is formed between the nozzle proper and the yarn guide member and the exhaust air of the pneumatic false-twisting nozzle is discharged through this space. Accordingly, the jet air stream of the pneumatic false-twisting nozzle can be prevented from imparting a force acting in the yarn take-out direction to the twisted yarn taken out from the rotating rotor, the twisted yarn can be held effectively on the fiber-collecting portion of the rotor, and the power costs can be reduced by reducing the rotation speed of the rotating rotor. Moreover, in the yarn passing aperture of the pneumatic false-twisting nozzle, the large-diameter portion is formed on the yarn inlet side, the small-diameter portion is formed on the yarn outlet side and the step is formed in the midway, and the jet apertures are opened to the large-diameter portion tangentially to the inner face of the large-diameter portion in a direction inclined with respect to the axis of the large-diameter portion toward the step. Accordingly, when the twisted yarn is passed through the yarn passing aperture of the pneumatic false-twisting nozzle and compressed air is jetted from the jet aperture, the compressed air swirls along the inner face of the large-diameter portion and false twists can be imparted to the twisted yarn. In this case, since the swirling air stream positively turns the twisted yarn while pressing the twisted yarn to the step, the efficiency of false-twisting the twisted yarn can be remarkably increased, whereby the effects of reducing the consumption of compressed air and increasing the yarn tenacity can be attained even at a high spinning speed. Still further, if the above-mentioned step is formed, air jetted toward the yarn outlet side in the large-diameter portion is reflected on this step and flows in a reverse direction to the spinning direction of the twisted yarn, and therefore, undesirable force is not imposed in the yarn take-out direction on the twisted yarn between the rotating rotor and the pneumatic false-twisting nozzle and the yarn end can be held on the fiber-collecting portion of the rotor effectively. These are effects attained according to the present invention.

We claim:

1. A process for manufacturing a fasciated spun yarn, which comprises feeding separate single fibers formed by opening and drafting a continuous staple fiber bundle into a rotor, collecting and holding the single fibers on a fiber-collecting portion on the rotor and taking out the collected fibers through a center piece by delivery rollers while strongly false-twisting the collecting fibers in the same direction as that of true twists given by the rotor into a twisted yarn by false-twisting apparatus arranged between the rotor and the delivery rollers, wherein the separated single fibers are supplied to a travelling plane for the twisted yarn between the fiber-collecting portion of the rotor and the center piece to entangle some of the single fibers with the twisted yarn in the strongly false-twisted state, and the entangled single fibers are entwined around the periphery of the twisted yarn by subsequent release of the false twists of the twisted yarn.

2. A process for manufacturing a fasciated spun yarn according to claim 1, wherein the travelling plane for the twisted yarn is separated from the bottom face of the rotor by at least 3 mm.

3. A process for manufacturing a fasciated spun yarn according to claim 1, wherein the staple fiber bundle is opened and drafted into single fibers by a combing roller.

4. A process for manufacturing a fasciated spun yarn according to claim 1, wherein the false-twisting apparatus is a pneumatic false-twisting nozzle.

5. A process for manufacturing a fasciated spun yarn according to claim 1, wherein the yarn contact surface of the center piece is smoothly finished so that the false twists given by the false-twisting apparatus are strongly propagated to the fiber-collecting portion of the rotor.

6. An apparatus for manufacturing a fasciated spun yarn, which comprises opening means for opening and drafting a continuous staple fiber bundle into separate single fibers, a rotating rotor having a hollow rotor shaft providing a yarn passage and a fiber-collecting surface, a guide member for guiding the separated single fibers from the opening means into the rotating rotor and a pneumatic false-twisting nozzle arranged downstream of the hollow rotor shaft of the rotating rotor coaxially therewith and having a yarn passing aperture extended on the axis thereof, wherein the pneumatic false-twisting nozzle is constructed so that jet air stream from the pneumatic false-twisting nozzle is discharged from the yarn inlet side of the yarn passing aperture, jet apertures opened in such a direction as forming a vortex swirling in a reverse direction to the rotation direction of the rotor formed on the pneumatic false twisting nozzle, a space formed between the bottom face of the rotating rotor and an annular plane defined by a generating line connecting the fiber-collecting portion of the rotating rotor and the apex of the yarn passage of the hollow rotor shaft, and a guide outlet of the guide member arranged between the fiber-collecting portion of the rotor and the apex of the yarn passage of the hollow rotor shaft.

7. An apparatus as set forth in claim 6, wherein a center piece having a yarn passage extended on the axis thereof and an umbrella-like apex is fitted in the yarn passage of the hollow rotor shaft of the rotor.

8. An apparatus as set forth in claim 7, wherein the center piece has an umbrella-like apex projected over the fiber-collecting portion of the rotor with respect to the bottom of the rotor.

9. An apparatus as set forth in claim 6, wherein the nozzle proper of the pneumatic false-twisting nozzle is arranged with a certain distance from the hollow rotor shaft of the rotating rotor, a closing cylinder capable of blocking this distance fitted on the periphery of the yarn inlet side portion of the nozzle proper freely slidable in the axial direction, an urging member arranged to urge the closed cylinder toward the yarn outlet side, a stopper arranged to restrict said urging, an annular piston chamber formed on the yarn outlet side of the closing cylinder, jet apertures connecting the annular piston chamber to the yarn passing aperture of the false-twisting nozzle formed on the nozzle proper so that the jet apertures are opened toward the yarn inlet side end of the yarn passing-aperture of the false-twisting nozzle, and the annular piston chamber is constructed so that the annular piston chamber can communicate with a compressed air source.

10. An apparatus as set forth in claim 6, wherein in the yarn passing aperture of the false-twisting nozzle, a large-diameter portion is formed on the yarn inlet side, a small-diameter portion is formed on the yarn outlet side and a step is formed midway, and jet apertures are opened in the yarn passing aperture of the pneumatic false-twisting nozzle tangentially to the inner surface of the large-diameter portion in a direction inclined to the axis of the large-diameter portion so that air jetted from the jet apertures is directed to the step.

11. An apparatus as set forth in claim 10, wherein the diameter d of the small-diameter portion of the yarn passing aperture of the pneumatic false-twisting nozzle satisfies the requirement of $0.5\ mm < d < 2.0\ mm$.

* * * * *